United States Patent [19]

Vesligaj

[11] Patent Number: 4,912,830

[45] Date of Patent: Apr. 3, 1990

[54] TARGET

[76] Inventor: Zeljko Vesligaj, 145 Richard Path, Nissequogue, N.Y. 11780

[21] Appl. No.: 331,824

[22] Filed: Apr. 3, 1989

Related U.S. Application Data

[62] Division of Ser. No. 225,482, Jul. 28, 1988.

[51] Int. Cl.[4] ..... B23P 25/00

[52] U.S. Cl. ..... 29/458; 29/525; 29/527.1; 264/275

[58] Field of Search ..... 264/275, 278; 273/80.2, 273/167 F, 169, 170, 171, 172, 173, 183 D, 194 B; 29/458, 527.1, 527, 2, 525

[56] References Cited

U.S. PATENT DOCUMENTS

| | | | |
|---|---|---|---|
| 2,534,947 | 12/1950 | Bright | 264/275 X |
| 3,601,177 | 8/1971 | Hall | 29/527.1 X |
| 3,873,094 | 3/1975 | Sebo et al. | 273/163 R |
| 4,508,350 | 4/1985 | Duclos | 273/169 X |
| 4,650,626 | 3/1987 | Kurokawa | 264/278 |

*Primary Examiner*—Joseph M. Gorski
*Assistant Examiner*—Andrew E. Rawlins
*Attorney, Agent, or Firm*—Leonard Belkin

[57] ABSTRACT

A golf putting head having a lightweight plastic housing with a front wall forming a front surface for making contact with a golf ball, a pair of rearwardly spaced receptacles joined by a platform along the bottom of the club, and a weight having flanks within the receptacles joined by a section, the weight being fully contained within the plastic housing. The weight of the head is varied by the density of the material selected for the weight without changing the size and shape of the club. A sighting aid is provided between the receptacles. A method is also disclosed for manufacturing the head.

2 Claims, 1 Drawing Sheet

TARGET

This is a division of Ser. No. 225,482, filed Jan. 28, 1988.

BACKGROUND OF THE INVENTION

This invention relates to a golf club putter and particularly to a putter which can be constructed in a variety of weights without altering the size or shape of the club.

In the present state of the art of golf putter club design, club weight is changed by altering the size and/or shape of the club. Typical materials in use for putters are copper, brass, and die cast materials. A very heavy club can result in a large and unwieldy piece to handle. In addition, it has been found that the more weight which can be concentrated at or near the "sweet spot", or center of gravity of the club, the more effective and comfortable is the use of the club, provided the distribution in weight is such as to maintain proper balance for the user. Thus, and especially in the heavier clubs, where more bulk is required to obtain the desired weight, the more difficult it is to combine the concentration of weight in the proper location and to maintain proper balance.

There is no teaching or suggestion of the present invention in the prior art as exemplified by U.S. Pat. Nos. De. 275,981, 3,749,408, 3,951,415, 4,043,563, 4,085,934, 4,121,832, 4,128,244, 4,167,268, 4,265,451, 4,508,350, and 4,519,612.

SUMMARY OF THE INVENTION

In this invention there is provided a golf club in which change in weight of the club can be accomplished without altering the size and shape of the club. In addition, in accordance with the principles of this invention, it is possible to concentrate to a degree heretofore unattainable the mass of the club at or near the sweet spot of the club while at the same time maintaining a proper balance in the hands of the user. A preferred embodiment of this invention consists of a light weight plastic sheath with a socket to accommodate a heavy weight material. In order to change the weight of the club, the material is changed, not the size or shape, to go into the socket. In addition, this embodiment of the club incorporates other features including that of a weight distribution which improves the balance of the club and provides sighting and alignment assistance.

It is thus a principal object of this invention to provide an improved golf club permitting club weight to be selected without altering the size or shape of the club.

Other advantages and objects of this invention will become obvious from the following detailed description of preferred embodiments of this invention.

DETAILED DESCRIPTION OF THE PREFERRED EMBODIMENTS

Figure 1:
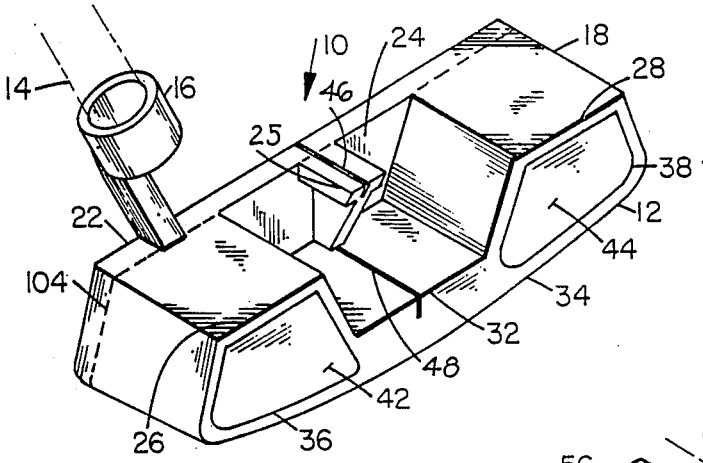
FIG. 1 is a perspective view of a putter head incorporating the principles of the present invention.
Figure 2:
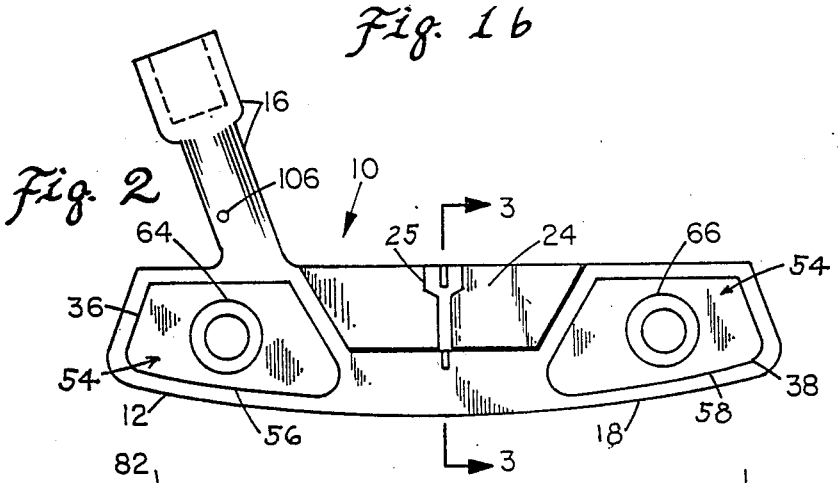
FIG. 2 is a back elevational view of the putter of FIG. 1 with the cover plates removed showing the slug or weight in place.
Figure 3:
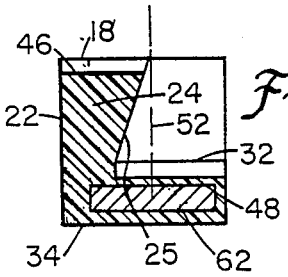
FIG. 3 is a view along 3—3 of FIG. 2.

Referring to FIGS. 1, 2, and 3, golf club putter 10 consists of a head 12, connected to a shaft 14 shown in phantom by way of a hozel or column 16 extending from and integral with head 12. Head 12 consists of an injection molded body 18 of suitable plastic material to be described below which has a front striking surface 22 on a front wall 24, and a pair of rearwardly extending receptacles 26 and 28 sloped toward one middle and forming a platform 32 which is located above the bottom 34 of head 12. Receptacles 26 and 28 are provided with openings 36 and 38, respectively, at the rear and covered with a pair of caps 42 and 44, respectively, to be described below.

It will be seen that rear wall 24 is provided with a protruding extension 25 which slopes upwardly and rearwardly. A pair of grooves 46 and 48 perpendicular to front surface 22 are formed in and extend back along the top surfaces of extension 25 and platform 32, respectively. These grooves, when viewed by the golfer along line of sight 52 as he uses the club having head 12 can use the two grooves as a way of aligning head 12. This feature can be enhanced by snapping within grooves 46 and 48 strips of material of a contrasting color.

Figure 1A:
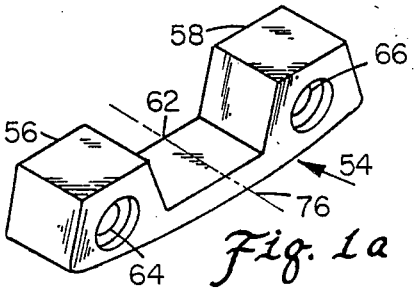
FIG. 1*a* is a perspective view of the slug or weight located within the putter head shown in FIG. 1.

Within head 12 is a weight 54 whose details are shown in FIG. 1*a*. There it will be seen that weight 54 has a pair of flanks or lobes 56 and 58 joined by a thin section 62. A pair of countersunk holes 64 and 66, respectively, are located in flanks 56 and 58, respectively, to receive caps 42 and 44, respectively.

Figure 4:
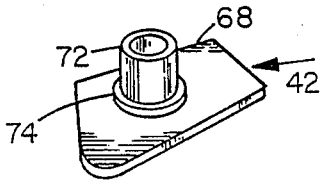
FIG. 4 is a perspective view of a cover plate.

In FIG. 1 caps 42 and 44 are shown in place. In FIG. 2 the rear of head 12 is shown with these caps removed. The details of cap 42 are shown in FIG. 4. It will be seen that cap 42 has a plate 68 designed to fill opening 36 and a cylinder 72 with a shoulder 74 to fill countersunk hole 64. The purpose of this particular configuration will be described below. Cap 44 is similar in construction.

In one embodiment of the invention, weight 54 is perfectly balanced so that its center of gravity is located along an axis 76 halfway between the extremities of flanks or lobes 56 and 58. Axis 76 is at right angles to the long dimension of weight 54, in other words, from front to back of club 10 when weight 54 is installed, as seen in FIG. 1*a*. The desired weight of club 10 is obtained predominately by the selection of the material, usually a metal, making up weight 54 as the plastic sheathing is very light. Typical such metals are lead, aluminum, iron, steel, copper, alloys, etc., which may be cast or machined to obtain the particular weight desired.

Figure 1B:
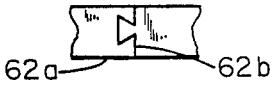
FIG. 1*b* shows a side view of a portion of the joining section of FIG. 1*a* with a modified construction.

In another embodiment of this invention, flank or lobe 56 may be made of a metal or alloy having a higher or different density than flank or lobe 58. It will be seen that hozel or column 16 is joined to head 12 closer to or over flank or lobe 56 so that a better balance for the user of the club 10 is attained by, for example, increasing the weight of lobe 56 as compared to lobe 58 depending on the position of column 16. In this embodiment, lobes 56 and 58 would be joined together, as seen in FIG. 1*b*, through section 62*a* by way of a joint 62*b* to obtain the rigidity, feel and increased weight properly not obtainable in other clubs. The use of dovetail joint 62*b* makes it possible to interchange lobes of different weights without altering the overall configuration of club 10.

Another advantage of having column 16 closer to lobe 56 is that it eliminates a possible obstruction in the view by the user of the alignment and formed by the combination of grooves 46 and 48.

The construction of club 10 is designed to facilitate its manufacture at a cost which is competitive with, and in many cases much cheaper than, very sophisticated clubs which are available at very high cost to the golfer.

Figure 5:
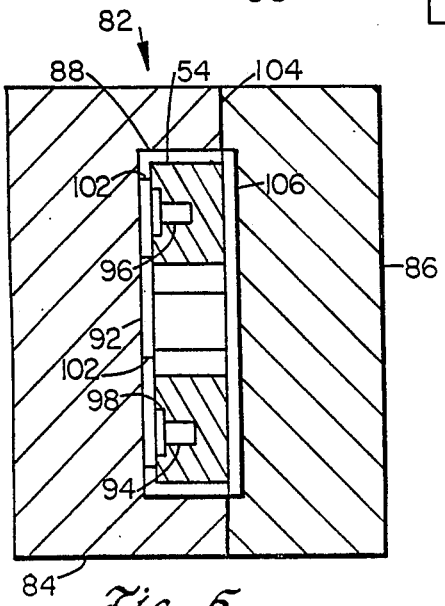
FIG. 5 is a section view through a mold prepared for injection molding of the club head with the slug or weight in place.

For a description of how club 10 may be manufactured, reference is made to FIG. 5 wherein is illustrated a mold 82 for plastic injection consisting of a pair of parts 84 and 86. Part 84 has a cavity 88 which is shaped as the female counterpart to head 12 with its inner surface 92 designed to form the rear portion of head 12. Mounted on surface 92 are a pair of projections 94 and 96 with multiple shoulders 98 and 102, respectively, on which is mounted weight 54 whose upper (front) surfaces of flanks or lobes 56 and 58 are coextensive with the part line 104 formed between parts 84 and 86. Part 86 is provided with a dished out section 106 which when the plastic is injected forms the front wall 24 of head 12.

Parts 84 and 86 of mold 82 are provided with the remaining internal structure as known in the art to provide the shape of head 12 after injection and cooling.

After the plastic, such as a polycarbonate or a polyimide, is injected under high pressures, typically 20,000–30,000 psi, and cooled, mold pieces 84 and 86 are separated, leaving spaces left by shoulders 102 for the insertion of caps 42, a barely visible part line 104 (seen in FIG. 1), and a small spot 106 (seen if FIG. 2) where the plastic was injected. It should be noted that plastic sheathed clubs have recently come into use but in those constructions the plastic shell is produced first and the molten metal is poured into the cavities which may be lined with a metal as in U.S. Pat. No. 4,508,350.

The method of making the club according to the principles of this invention is a substantial improvement over prior techniques because it is possible to bring the costs down substantially.

There has thus been described an improved golf putting club and method for manufacturing same. While only certain preferred embodiments of the invention have been described, it is understood that many variations are possible without departing from the principles of this invention as defined in the claims which follow.

What is claimed is:

1. A method of manufacturing a plastic sheathed golf head comprising the steps of mounting within a cavity of a first mold a metal weight consisting of a pair of spaced flanks joined by a thin section, each of said flanks having a countersunk hole facing the bottom of said cavity, the bottom surface of said cavity in said first mold having a projection extending into each said countersunk hole, thereby supporting said weight spaced from the walls of said cavity, closing said cavity with a second mold, thereby forming a space between said weight and a flat surface of said second mold, injecting under high pressure a plastic material, thereby filling the spaces surrounding said weight, cooling said plastic material separating and molds after cooling, removing said molds and each said projection, thereby receiving each projection from its respective hole, and inserting into each of said countersunk holes a cap forming an outer surface of said golf head to complete said golf head.

2. The method of claim 1 in which said projections are provided with multiple shoulders to fill said countersunk holes.

* * * * *